US009816513B2

(12) United States Patent
Heli et al.

(10) Patent No.: US 9,816,513 B2
(45) Date of Patent: Nov. 14, 2017

(54) MODULAR FAN UNIT

(71) Applicants: Thomas Heli, Langenburg (DE); Christian Schler, Dorzbach (DE); Ralf Balbach, Niederstetten (DE)

(72) Inventors: Thomas Heli, Langenburg (DE); Christian Schler, Dorzbach (DE); Ralf Balbach, Niederstetten (DE)

(73) Assignee: EBM-PAPST MULFINGEN GMBH & CO. KG (DE)

( * ) Notice: Subject to any disclaimer, the term of this patent is extended or adjusted under 35 U.S.C. 154(b) by 333 days.

(21) Appl. No.: 14/550,133

(22) Filed: Nov. 21, 2014

(65) Prior Publication Data

US 2015/0147170 A1 May 28, 2015

(30) Foreign Application Priority Data

Nov. 25, 2013 (DE) ..... 10 2013 223 983

(51) Int. Cl.
*F04D 29/66* (2006.01)
*F04D 19/00* (2006.01)
(Continued)

(52) U.S. Cl.
CPC ..... *F04D 19/002* (2013.01); *F04D 25/08* (2013.01); *F04D 29/522* (2013.01); *F04D 29/663* (2013.01)

(58) Field of Classification Search
CPC ..... F04D 19/002; F04D 25/08; F04D 29/522; F04D 29/663
(Continued)

(56) References Cited

U.S. PATENT DOCUMENTS 2,558,541 A * 6/1951 Cotten ..... F16M 5/00 248/638
2,755,015 A * 7/1956 Douglas ..... F04D 29/646 416/244 R
(Continued)

FOREIGN PATENT DOCUMENTS

DE 202009017511 U1 9/2011
JP GB 2499356 A * 8/2013 ..... F04D 25/08

*Primary Examiner* — Kenneth Bomberg
*Assistant Examiner* — Brian Delrue
(74) *Attorney, Agent, or Firm* — Tarolli, Sundheim, Covell & Tummino LLP

(57) ABSTRACT

A modular fan unit of a diagonal and/or axial fan having a housing that includes an inlet opening and an outflow opening. The housing accommodates a fan, that conveys the air at least in the axial direction and is divided perpendicularly to an axis (X-X) of the fan into at least two housing halves that are joined together. The housing forms a chamber in which the blades of the fan rotate around an axis and has a circumferential edge area in the vicinity of which the housing has a thickness B extending in the axis direction of the fan. A motor holding part has a dimension R as the maximum extension in the edge area and the chamber has an extension in the axis direction of the fan at a height of a dimension L, whereas the extension of the air inlet part has a dimension T in the area of the chamber. A ratio of the dimension B to the dimension R with respect to the ratio of the dimension L to the dimension T is within the range from 0.9 to 1.2. The noise emission of the fan during operation is minimized and the outer diameter of the modular fan unit is kept to a minimum.

7 Claims, 1 Drawing Sheet

(51) Int. Cl.
*F04D 25/08* (2006.01)
*F04D 29/52* (2006.01)

(58) Field of Classification Search
USPC ..... 415/119
See application file for complete search history.

(56) References Cited

U.S. PATENT DOCUMENTS 4,657,483 A * 4/1987 Bede ..... F04D 29/545 415/210.1
4,685,513 A * 8/1987 Longhouse ..... F01P 5/06 123/41.49
5,022,900 A * 6/1991 Bar-Yona ..... A62B 13/00 128/201.25
5,649,587 A * 7/1997 Plant ..... F01P 5/06 123/41.49
5,681,145 A * 10/1997 Neely ..... F04D 29/666 415/119
6,120,248 A * 9/2000 Litvin ..... F04D 29/646 416/247 R
6,494,676 B2 * 12/2002 Yokoyama ..... F04D 29/30 415/208.3
8,398,365 B2 * 3/2013 Hopkins ..... F04D 25/166 415/119
8,992,175 B2 * 3/2015 Heli ..... F04D 25/0613 415/121.2
2005/0118022 A1 * 6/2005 Fu ..... F04D 29/703 416/63
2008/0124234 A1 * 5/2008 Echazarreta ..... F04D 25/08 417/423.14
2010/0260608 A1 * 10/2010 Suzuki ..... F04D 29/326 416/204 R
2012/0243985 A1 * 9/2012 Nitta ..... F04D 25/0613 415/220
2013/0309065 A1 * 11/2013 Johnson ..... F04D 29/665 415/119
2016/0245306 A1 * 8/2016 Berroth ..... F04D 19/007
2016/0327058 A1 * 11/2016 Tyler ..... F04D 29/526

* cited by examiner

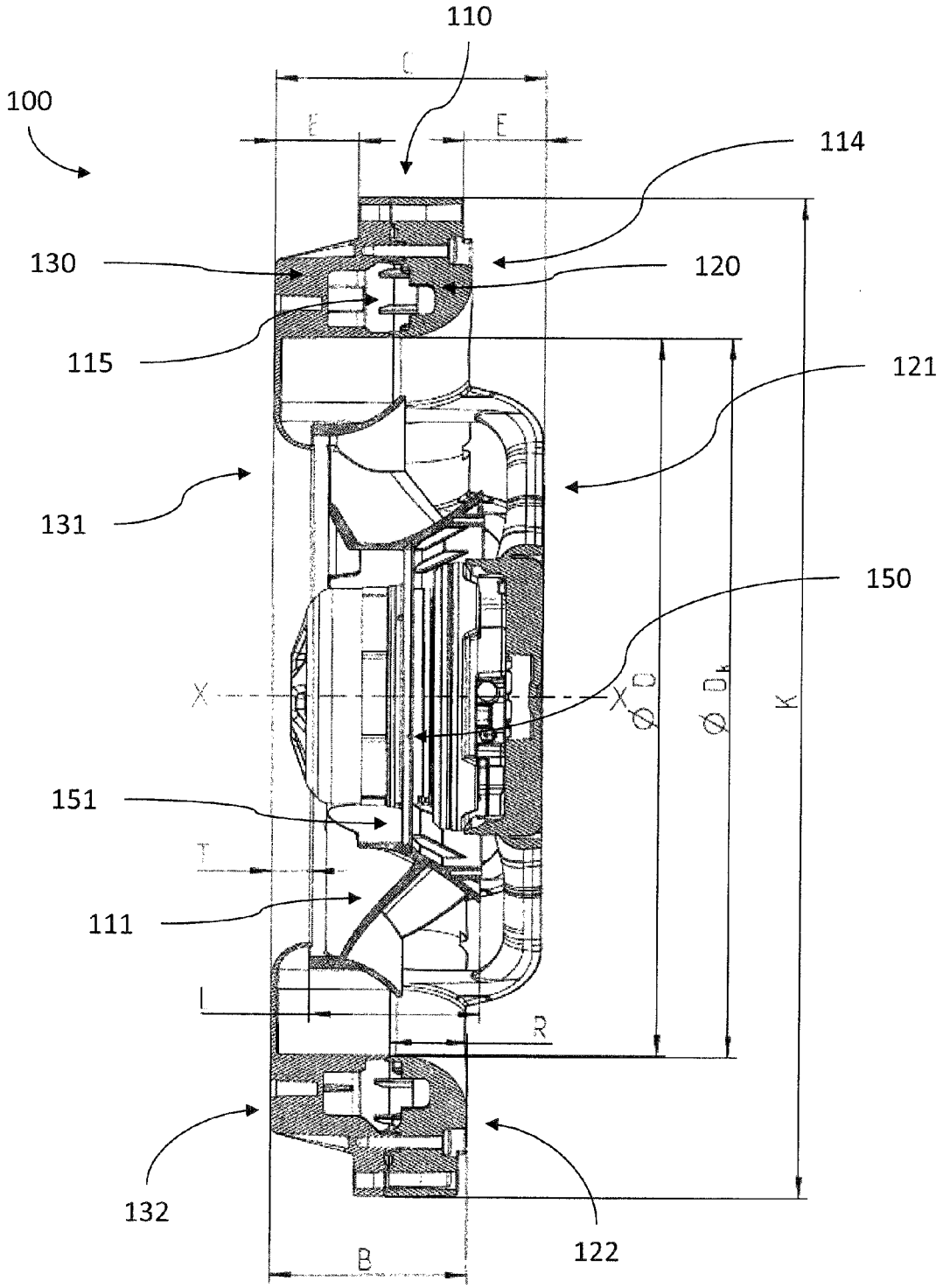
110
100
C
E
E
114
130
120
115
121
131
150
X
X
Ø D
Ø Dk
K
151
T
111
L
R
132
122
B

MODULAR FAN UNIT

RELATED APPLICATION

This application claims the benefit of German Patent Application Serial No. DE 102013223983.1, filed on Nov. 25, 2013, the disclosure of which is entirely incorporated herein by reference.

The invention relates to a modular fan unit of a diagonal and/or axial fan.

Such modular fan units are used as part of a filter fan for industrial systems such as, for example, switching cabinets. Here, the modular fan units can be configured as fans that blow air out or fans that suck air in.

For example, German utility model DE 20 2009 017 511 U1 of the applicant discloses a modular fan unit. The modular fan unit has a fan with an axial fan runner or a diagonal fan runner as the flow drive of the modular fan unit, and it is screwed to a filter frame by means of a fastening flange of the housing of the modular fan unit. As protection for the modular fan unit or as protection against accidental contact, the housing of the modular fan unit has a protective grid on both sides. With this modular fan unit, the housing is divided perpendicularly to the axis of the fan runner in the area of the housing edge into at least two detachably joined housing parts, namely, the motor holding part and the air inlet part. The motor holding part as well as the air inlet part are both configured in one piece and they comprise a protective grid structure. The protective grid structure of the motor holding part has a motor receptacle with fasteners in order to fasten the fan. The division of the housing into two halves, together with the one-piece configuration, permits a very simple installation of the fan in the housing of the modular fan unit. Moreover, as a result, the housing and the modular fan unit are very easy and cost-effective to manufacture, and the design of the modular fan unit can be very compact.

Modular fan units of the generic type can be arranged in the form of a stack in order to create an air-handling system. For example, U.S. Pat. No. 8,398,365 B2 describes such an air-handling system in which several modular fan units having rectangular outer contours are arranged in the form of an air-handling system. The rectangular outer contour makes it possible to arrange the modular fan units as close to each other as possible in the radial direction, thereby increasing the packing density of the modular fan units. A drawback of such air-handling systems lies in the noise emission. In this context, the cited U.S. patent teaches lining the outside of the airflow duct with noise-attenuation materials such as fiberglass-reinforced plastic and foam. Modular fan units with such linings, however, are laborious to manufacture. Moreover, such linings take up a great deal of installation space so that the outer dimensions of the modular fan unit are increased and thus the packing density is diminished.

The objective of the invention is to put forward a modular fan unit that generates a minimum amount of noise, whereby the outer dimension of the modular fan unit is minimized.

According to the invention, this objective is achieved by a modular fan unit having the features of independent claim 1. Advantageous refinements of the modular fan unit can be gleaned from subordinate claims 2 to 7.

According to the invention, the modular fan unit has a housing that has been provided with an inlet opening and an outflow opening. The housing accommodates a fan, whereby the fan can be an axial fan or a radial fan. In any case, the fan conveys the air at least in the axial direction. The housing is divided perpendicularly to the middle axis of the fan into at least two housing halves that are joined to each other, namely, the motor holding part and the air inlet part.

The housing forms a chamber in which the blades of the fan are accommodated so as to rotate around the axis of the fan. Moreover, the housing has a circumferential, radially extending edge in the vicinity of which the housing has a thickness B extending in the axis direction of the fan. The motor holding part has a dimension R as the maximum extension in the edge area in the axis direction of the fan. Moreover, the chamber has an extension in the axis direction of the fan at the height of the dimension L, whereas the extension of the air inlet part in the axis direction of the fan has a dimension T in the area of the chamber. By selecting a ratio of the dimension B to the dimension R with respect to the ratio of the dimension L to the dimension T within the range from 0.9 to 1.2, the noise emission of the fan during operation is minimized. As a result, no subsequent measures have to be taken to damp the noise that is emitted. Noise-damping layers that would increase the physical size of the modular fan unit are not necessary, as a result of which the outer diameter of the modular fan unit is kept to a minimum.

It has proven to be advantageous for the diameter of the chamber to be approximately 1.04 times larger than the outer diameter of the fan runner. This creates a gap between the outer diameter of the fan runner and the diameter of the chamber that is about 2% of the outer diameter of the fan runner, as a result of which the noise emission of the fan during operation is further minimized.

In an advantageous embodiment, the housing, if viewed from the top (top view) has an essentially rectangular outer contour. As a result, modular fan units according to the invention can be arranged modularly to form an air-handling system, so that several modular fan units with rectangular outer contours can be arranged in the form of an air-handling system. The rectangular outer contour makes it possible to arrange the modular fan units as close to each other as possible in the radial direction, thereby increasing the packing density of the modular fan units.

It has proven to be advantageous for the motor holding part to have a set-back dimension E and for the air inlet part to likewise have the set-back dimension E, whereby the set-back depth a, as the ratio of the set-back dimension E to the maximum axial extension C of the housing in the axis direction of the fan, is within the range from 0.2 to 0.35. Consequently, $E=a*c$, wherein $0.2 \leq a \leq 0.35$.

Moreover, it has proven to be advantageous for the ratio of the maximum outer dimension K of the housing to the impeller diameter D to be 1.15 at the maximum. Here, if the outer geometry of the housing is circular, then K refers to the outer diameter. In the case of a rectangular outer contour of the housing, especially an essentially square outer contour, K refers to the edge dimension of the longest side of the housing.

In another advantageous embodiment, the housing has a circumferential wall ring, whereby the wall ring has a circumferential hollow chamber, also referred to below as a hollow chamber ring. The wall ring is formed by the edge area of the air inlet part and/or of the motor holding part. Owing to the configuration as a hollow chamber ring, on the one hand, a high mechanical stability is achieved for the modular fan unit, whereas on the other hand, the noise emission during operation is further minimized.

Further advantages, special features and practical refinements of the invention can be gleaned from the subordinate claims and the presentation below of a preferred embodiment on the basis of the FIGURE.

The FIGURE shows the following:

FIG. 1 a modular fan unit according to the invention, in a cross-sectional view.

FIG. 1 shows a cross-sectional view through the modular fan unit according to the invention. The modular fan unit 100 has a housing 110 that has been provided with an inlet opening 131 and an outflow opening 121. The housing 110 is configured as a housing with an essentially square outer contour. An axial fan 150 is accommodated in the housing 110, and it serves to convey the air at least in the axial direction. The housing 110 is configured in two parts, whereby it essentially has a division plane perpendicular to the axis X-X of the fan 150. The two housing halves that are joined to each other are, on the one hand, the motor holding part 120 and, on the other hand, the air inlet part 130. The housing 110 forms in its center a chamber 111 in which the blades 151 of the axial fan 150 are accommodated so as to rotate around the axis X-X of the axial fan 150. Moreover, the housing 110 forms a circumferential edge area 122, 132 in the vicinity of which the housing 110 has a thickness B extending in the axis direction X-X of the axial fan 150. The motor holding part 120 has a dimension R as the maximum extension in the edge area 122 in the axis direction X-X of the axial fan 150. Moreover, the chamber 111 has an extension in the axis direction X-X of the axial fan 150 at the height of the dimension L, whereas the extension of the air inlet part 130 in the axis direction X-X of the axial fan 150 has a dimension T in the area of the chamber 111. The ratio of the dimension B to the dimension R with respect to the ratio of the dimension L to the dimension T is within the range from 0.9 to 1.2. Thus, $B/R=b*L/T$ wherein $0.9 \leq b \leq 1.2$. Thanks to this geometry ratio, the noise emissions of the axial fan 150 are minimized, so that no noise emissions that have already been generated have to be damped in order to achieve a soft running noise. The fact that insulation measures can be dispensed with means that the physical size of the modular fan unit 100 can be minimized. Moreover, in comparison to known designs, material is saved and the assembly work is reduced, without this coming at the expense of a loud operating noise. The essentially square outer contour of the housing 110 makes it possible to arrange several modular fan units 100 next to each other at a maximum packing density in the form of a stack. By dispensing with insulation measures in the interior of the modular fan unit 100, the diameter D of the fan runner with respect to the outer diameter K of the housing 110 can be maximized, as a result of which the fan output with respect to the required surface area of the modular fan unit is likewise maximized. In the present embodiment, this ratio is 1.15.

The diameter $D_K$ of the chamber 111 is 4% larger than the outer diameter D of the fan runner. This creates a gap between the outer diameter of the fan runner and the diameter of the chamber $D_K$ amounting to approximately 2% of the outer diameter of the fan runner, as a result of which the noise emission of the fan 150 during operation is further minimized.

The motor holding part 120 as well as the air inlet part 130 have a set-back dimension E, whereby the set-back depth a, as the ratio of the set-back dimension E to the maximum axial extension C of the housing 110 in the axis direction of the X-X of the fan 150, has a value of 0.27, that is to say, a=0.27.

The housing 110 has a circumferential wall ring with a square outer contour, whereby the wall ring has a circumferential hollow chamber 115. Owing to the configuration as a hollow chamber ring, on the one hand, a high mechanical stability is achieved for the modular fan unit 100 against bending and twisting, whereas on the other hand, the noise emission during operation is further minimized.

The embodiment presented here is only an example of the present invention and must therefore not be construed in a limiting manner. Alternative embodiments considered by the person skilled in the art are likewise encompassed by the scope of protection of the present invention.

LIST OF REFERENCE NUMERALS

100 modular fan unit
110 housing
111 chamber
114 wall ring
115 hollow chamber
120 motor holding part
121 outflow opening
122 edge area
130 air inlet part
131 inlet opening
132 edge area
150 fan
151 blade
B thickness
C maximum axial extension of the housing
D outer diameter of the fan runner
$D_K$ diameter of the chamber
E set-back dimension
L chamber extension in the axis direction (X-X) of the fan
R maximum extension of the motor holding part in the edge area in the axis direction (X-X) of the fan
T extension of the air inlet part in the axis direction (X-X) of the fan in the area of the chamber

The invention claimed is:

1. A modular fan unit, comprising a housing that has been provided with an inlet opening and an outflow opening and a fan that is accommodated in the housing and that conveys air at least in the axial direction, whereby the housing is divided perpendicularly to the axis of the fan into at least two housing halves that are joined to each other, namely, a motor holding part and an air inlet part, and whereby the housing forms a chamber in which blades of the axial fan are accommodated so as to rotate around the axis of the axial fan, and the housing also has a circumferential edge area in the vicinity of which the housing has a thickness having a dimension B extending in the axis direction of the axial fan, and the motor holding part has a dimension R as the maximum extension in the edge area in the axis direction of the fan, and moreover, the chamber has an extension in the axis direction of the fan at the height of the dimension L, and the extension of the air inlet part in the axis direction of the fan has a dimension T in the area of the chamber, wherein a ratio of the dimension B to the dimension R with respect to the ratio of the dimension L to the dimension T is governed by the equation $B/R=b*L/T$ and b is within the range from 0.9 to 1.2.

2. The modular fan unit according to claim 1, wherein a diameter $D_K$ of the chamber is approximately 4% larger than an outer diameter D of the fan runner.

3. The modular fan unit according to claim 1, wherein the housing, as seen in a top view, has an essentially rectangular outer contour.

4. The modular fan unit according to claim 1, wherein a the motor holding part and the air inlet part each have a set-back dimension E, whereby a set-back depth, as the ratio of the set-back dimension E to a maximum axial extension C of the housing in the axis direction of the fan, is within the range from 0.2 to 0.35.

5. The modular fan unit according to claim 1, wherein a ratio of a maximum outer dimension K of the housing to an impeller diameter D is 1.15 at the maximum.

6. The modular fan unit according to claim 1, wherein the housing has a circumferential wall ring, whereby the wall ring has a circumferential hollow chamber.

7. The modular fan unit according to claim 6, wherein the circumferential hollow chamber is formed in an edge area of the air inlet part and/or in an edge area of the motor holding part.

* * * * *